US006722898B2

(12) United States Patent
Peloza et al.

(10) Patent No.: US 6,722,898 B2
(45) Date of Patent: Apr. 20, 2004

(54) CONNECTOR WITH IMPROVED GROUNDING MEANS

(75) Inventors: Kirk B. Peloza, Naperville, IL (US); Yew Teck Yap, Naperville, IL (US); Timothy E. Purkis, Naperville, IL (US); Jose H. Chavez, Jr., Romeoville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/272,963

(22) Filed: Oct. 17, 2002

(65) Prior Publication Data

US 2003/0073331 A1 Apr. 17, 2003

Related U.S. Application Data

(60) Provisional application No. 60/330,202, filed on Oct. 17, 2001.

(51) Int. Cl.[7] ..... H01R 4/66
(52) U.S. Cl. ..... 439/108
(58) Field of Search ..... 439/98, 108, 497, 439/579

(56) References Cited

U.S. PATENT DOCUMENTS

| | | | | |
|---|---|---|---|---|
| 4,415,223 A | | 11/1983 | Asick | |
| 5,057,038 A | | 10/1991 | Bowen et al. | 439/497 |
| 5,199,891 A | | 4/1993 | Reed | 439/98 |
| 5,281,150 A | | 1/1994 | Bundga et al. | 439/67 |
| 5,711,686 A | | 1/1998 | O'Sullivan et al. | 439/610 |
| 5,823,825 A | | 10/1998 | Murphy | 439/610 |
| 6,190,202 B1 | | 2/2001 | Lai | 439/578 |
| 6,210,230 B1 | * | 4/2001 | Lai | 439/610 |
| 6,280,209 B1 | * | 8/2001 | Bassler et al. | 439/101 |
| 6,299,487 B1 | * | 10/2001 | Lopata et al. | 439/610 |
| 6,468,110 B2 | * | 10/2002 | Fujino et al. | 439/610 |
| 6,489,563 B1 | * | 12/2002 | Zhao et al. | 174/88 C |

* cited by examiner

*Primary Examiner*—Javaid H. Nasri
*Assistant Examiner*—Thanh-Tam Le
(74) *Attorney, Agent, or Firm*—Stephen Z. Weiss

(57) ABSTRACT

An improved termination assembly for multiple grounds of a multi-wire cable is disclosed. The assembly includes a U-shaped retention clip that engages with a termination portion of a ground terminal housed in a connector housing. The clip has at least one notch formed in an edge thereof which is used to locate a drain, or ground, wire in place on the clip in position for soldering the drain wire to the clip. The termination portion may be provided with an opening aligned with one of the notches of the clip so that two drain wires of the cable may be oriented above the signal wires of the cables in similar positions to impose a measure of mechanical uniformity on the termination.

17 Claims, 4 Drawing Sheets

CONNECTOR WITH IMPROVED GROUNDING MEANS

This application claims the benefit of provisional application No. 60/330,202 filed Oct. 17, 2001.

BACKGROUND OF THE INVENTION

This invention generally relates to the art of electrical connectors and, more particularly, to a terminal module for connection to a signal cable having a ground member.

In high speed data communications, many electronic devices rely upon transmission lines to transmit signals between related devices or peripheral devices and circuit boards of a computer, for instance. These transmission lines incorporate signal cables that are capable of high-speed data transmissions. A typical signal cable may use what are known as one or more twisted pairs of signal wires that are twisted together along the length of the cable. One or more grounding drain wires also may be twisted along with the signal wires. The wires may be encircled by an associated grounding shield, such as a metal braided tube, either with or without the drain wires. The signal wires typically are encased by an insulating covering, and the entire cable typically is encased by an outer insulating sheath.

In order to maintain electrical performance integrity from such a transmission line or cable to the circuitry of an associated electronic device, it is desirable to obtain a substantially constant impedance from the transmission line to the circuitry to avoid large changes in the impedance. Problems in controlling the impedance of a connector at a connector mating interface is well known, because the impedance of a conventional connector typically changes through the connector and across the interface of two mating connector components. The signal strength is reduced across a connector interface presenting changes in impedance and some of the signal is reflected back to the signal source.

Twisted wire cable is designed to maintain a desired impedance through an electrical transmission line, and this is accomplished by maintaining a constant geometry or physical arrangement of the signal conductors, the drain wires and/or the grounding shield. Unfortunately, an impedance drop usually is encountered in the termination area where the cable is terminated to a connector. This occurs when the signal conductors of a twisted pair are untwisted, oriented to mate with the termination portions of the cable connector and soldered thereto. It, therefore, is desirable to maintain a desired impedance as constant as possible throughout the connector and its termination to the cable. This is termed "impedance matching" in the connector arts.

When a signal cable is terminated to a connector, the twisted wires are untwisted and the braided shield surrounding the wire pairs may be peeled back and at least partially unbraided. This is done manually and it often results in moving the signal wires, the drain wires and/or the grounding shield out of their original geometry in which they exist in the cable. This introduces variability into the electrical performance. This rearrangement may lead to a decoupling of the ground and signal wires from their original state and it often results in an increase of impedance of the electrical assembly in the cable-connector termination area as compared to that of the cable. This increase in impedance may exceed the tolerances designed for the connector system and lead to large impedance discontinuities for the system, which will deleteriously impact the electrical performance of the system. This variability and rearrangement changes the physical characteristics of the system in the termination area, resulting in problems caused by an undesirable change in the impedance of the system through the connector interface.

The present invention is therefore directed to a unique termination structure for terminating the cable conductors at termination section of a cable connector.

SUMMARY OF THE INVENTION

A general object of the present invention is to provide a new and improved electrical connector for terminating to an end of a cable having at least one pair of signal wires and an associated ground.

Another object of the present invention is to provide a termination assembly for terminating a single or multiple signal channel transmission cable to a plug connector, in which the transmission cable includes at least one pair of differential signal wires, each such pair having a ground associated therewith, and the termination assembly including a ground terminal having a termination portion that extends rearwardly of an insulative housing thereof, the termination portion including a signal wire platform and a conductive retainer that engages the platform in a manner so as to retain the free ends of the signal cable and its two associated differential signal wires in a particular position within the termination assembly.

A further object of the present invention is to provide an improved termination assembly for use in terminating differential signal wires to a connector wherein the termination assembly includes an insulative housing and a plurality of conductive terminals supported thereby, at least two of the terminals being adapted for respective termination to the differential signal wires and another of the terminals being a ground termination terminal for engaging a ground associated with the differential signal wires, the termination assembly further including a conductive retainer that engages and extends over the ground terminal, the ground terminal termination portion and the retainer cooperatively defining a conductive enclosure that encompasses a free end of the signal cable from which the signal wires and ground extend, the retainer and the termination portion orienting the ground members in a fixed position with respect to the differential signal wires.

Yet a still further object of the present invention is to provide a means for orienting the ground wires of a signal cable containing two differential signal wires therein, the orienting means including openings formed in both the ground terminal termination portion and the retainer member, the openings being aligned with each other and providing shoulders against which the signal cable ground wires may be folded and soldered to the termination assembly, the openings being aligned with each other vertically so as to maintain the ground wires in a preselected arrangement with respect to each other and with respect to the differential signal wires.

These and other objects of the present invention are accomplished by way of the novel unique structure thereof.

In the exemplary embodiment of the invention, a plug-style connector is provided with an insulative housing having a mating end and a terminating end. A pair of signal terminals are supported by the housing and have contact portions disposed proximate to the mating end thereof and termination portions disposed proximate to the terminating end for termination to the pair of signal wires. The housing also includes a ground terminal having a contact portion disposed proximate to the mating end thereof and a termination portion disposed proximate to the terminating end for termination to the ground member. A signal cable retention clip is provided independent of the ground terminal and is structured so as ro engage and cooperate with the ground terminal termination portion thereof to clamp the cable therebetween and facilitate orientation of the signal wires and ground member of the cable.

According to one aspect of the present invention, the retention clip acts as a conductive retainer that is formed of conductive material and which combines with the ground terminal to form a shield about the free end of the signal cable, which has its outer insulating sheath cut-off to expose the cable's ground members and signal wires. The shield formed by the retainer clip and the ground terminal termination portion extends beyond the distal end of the sheath. The clip may further include deformable crimp portions that engage with the termination portion of the ground terminal so that the clip and the ground terminal termination portion cooperatively define both a conductive enclosure for the open end of the signal cable and a clamp about the distal end of the sheath of the cable to provide strain relief between the cable and the connector. The clip and the terminal cooperatively define a ground enclosure that encompasses the signal cable and extends over the entire circumference of the signal cable In another aspect of the present invention, the ground members of the signal cable may take the form of a pair of drain wires each, of which is associated with one of the two signal wires. The ground terminal termination portion and the retainer clip include means for locating the drain wires in a preselected orientation and also serve to maintain the drain wires in a particular orientation with respect to the signal wires that generally follows the original orientation that the drain wires exist in the cable. This locating means is provided by a hole, or slot, formed in the termination portion and retainer clip through which the drain wires may be inserted and bent over the outside thereof and over the free end of the signal cable with this configuration each bent drain wire has a metal surface upon which it may be soldered.

Other objects, features and advantages of the invention will be apparent from the following detailed description taken in connection with the accompanying drawings.

BRIEF DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
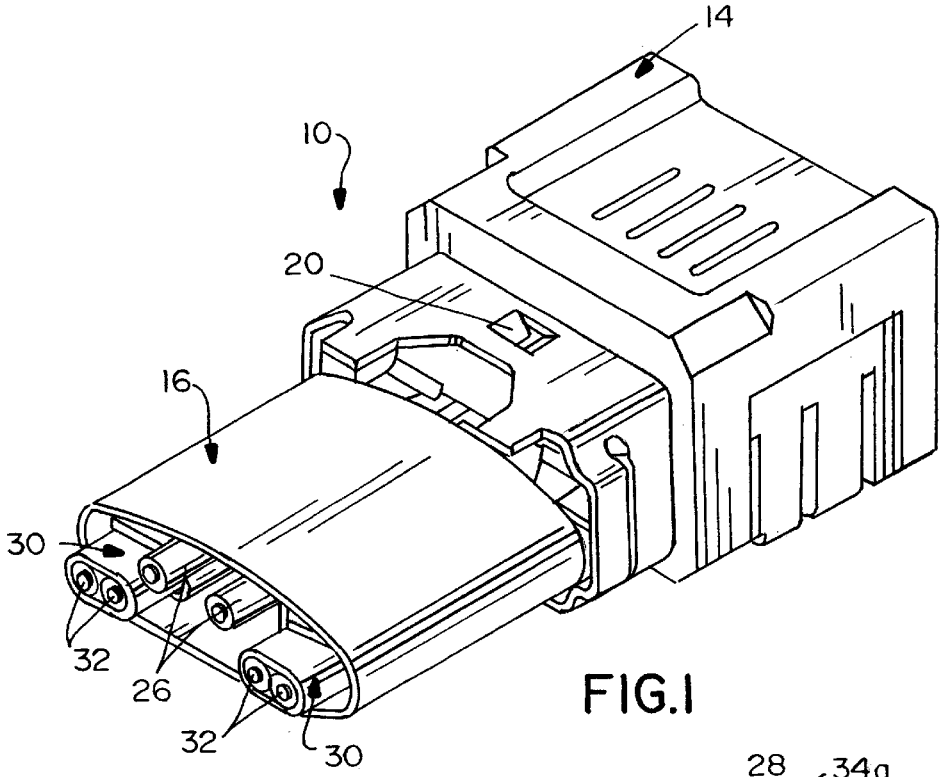
FIG. 1 is a perspective view taken from the rear of a cable connector assembly that utilizes a termination assembly constructed in accordance with the principles of the present invention.
Figure 3:
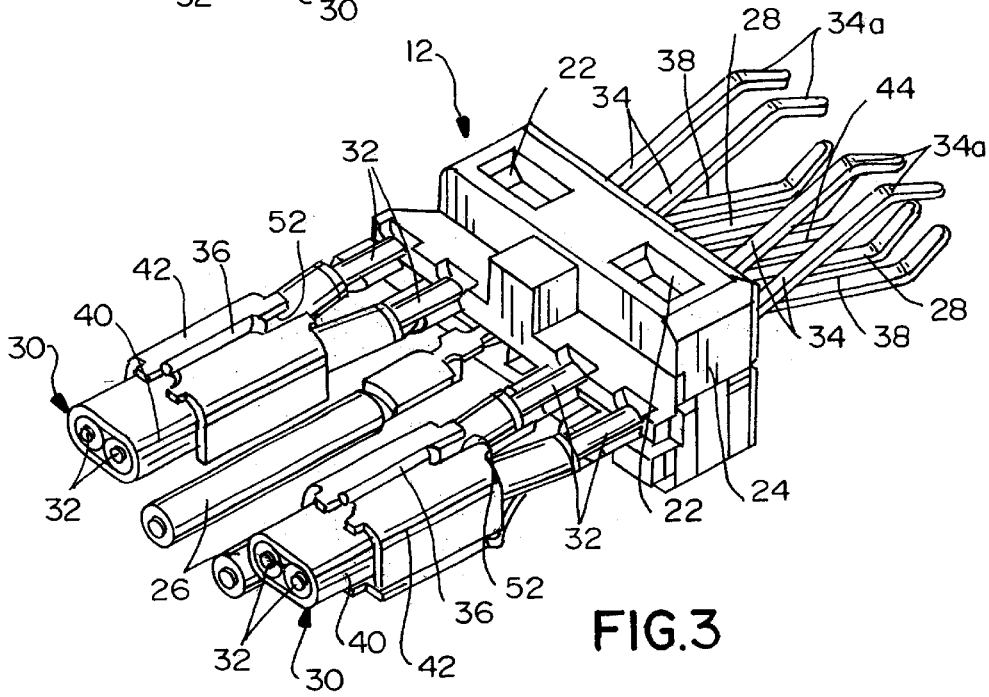
FIG. 3 is a perspective view of the interior portion of the connector of FIG. 1 removed for clarity to show the interior terminal module of the connector.
Figures 2, 6:
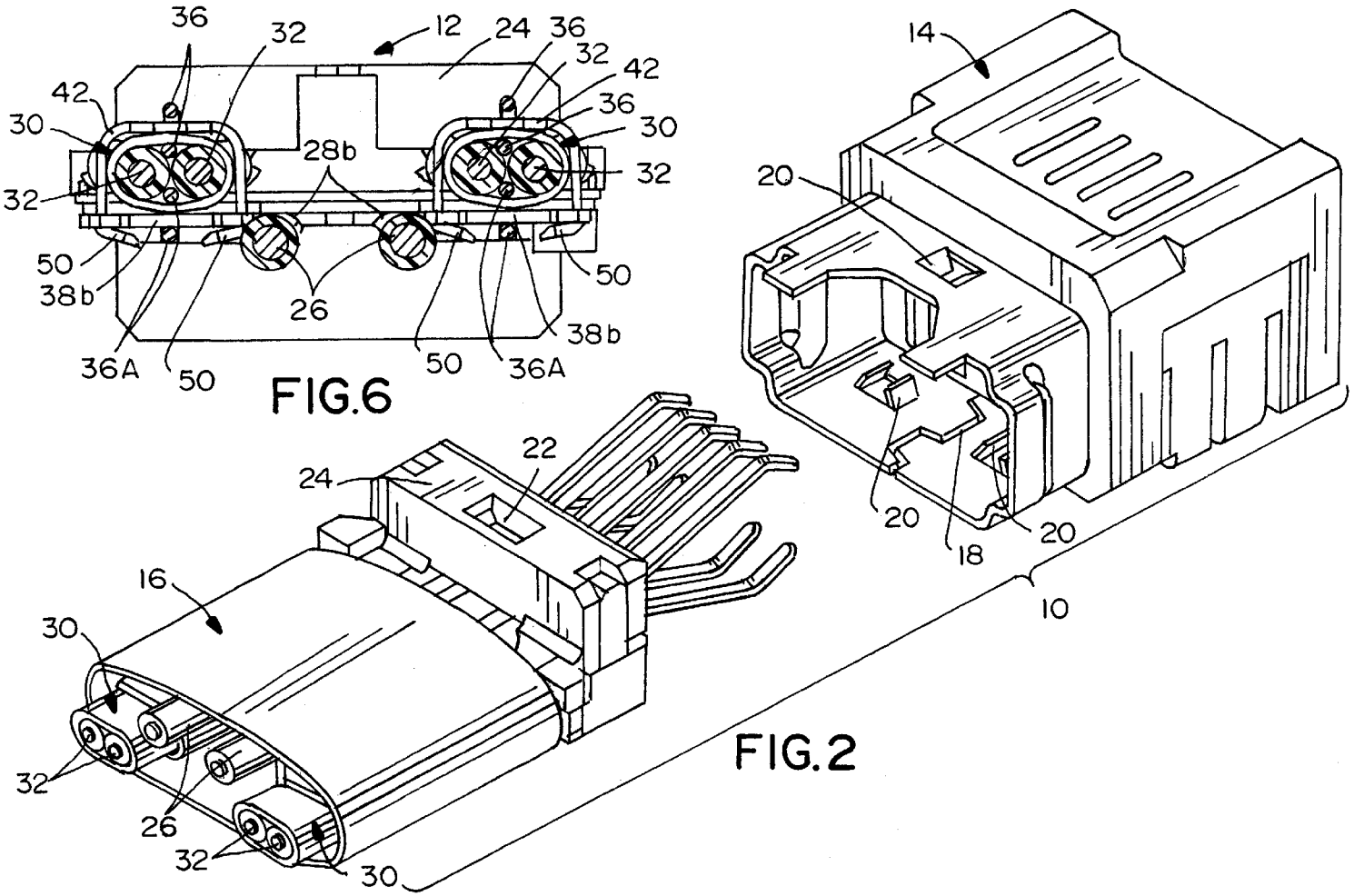
FIG. 2 is a partial exploded view of FIG. 1, with the connector outer cover removed from the connector assembly for clarity.
FIG. 6 is an elevational view looking toward the rear of the terminal module in FIG. 3.

Referring first to FIGS. 1–3, the invention is incorporated in a connector assembly, generally one for terminating a cable or cables to a connector. The drawings illustrate the invention as embodied in a plug connector 10 which preferably includes an internal terminal module, generally 12 (FIG. 3), that is surrounded by a front cover 14 (FIG. 2), which includes an inner conductive metal shielding shell 14*a* that has an insulative outer cover 14*b* applied thereto, such as by molding. The metal shielding shell 14*a* is stamped and formed of conductive sheet metal material which is joined together at a longitudinal seam 18, and which includes a plurality of securing tabs 20 which are positioned within a plurality of securing recesses 22 of a housing 24 of the terminal module 12 after the terminal module is inserted within the shell to hold the shell about the front of the connector assembly 10. The front, outer 14*b* cover serves to cover the housing 24 and provide a mating interface of the plug connector assembly 10 with a complementary mating connector (not shown). A plastic boot 16 may be wrapped around the termination area of the terminal module 12.

It should be noted that FIG. 2 shows one securing tab 20 on metal shell 14 and one securing recess 22 on the housing 24 at the tops thereof, whereas FIG. 3 shows two securing recesses 22 at the bottom of the housing 24. This illustrates that the number and placement of such securing tabs does not affect the securement of the shell 14 to the housing 24. The terminal module 12 is inverted in FIG. 3 versus its position within connector assembly 10 as oriented in FIGS. 1 and 2, in order to facilitate the illustration of the terminal module. This is noted in order to avoid confusion between the drawings.

The terminal module 12 (FIG. 3) is illustrated as having a structure by which two power cables 26 may be terminated to a corresponding pair of power terminals 28. The terminal module also is adapted to be terminated to a pair of signal cables, generally 30, with each signal cable carrying a differential signal channel therein and each such signal channel including a pair of differential signal wires 32 that are terminated to a corresponding pair of differential signal terminals 34. By differential signal wires, what is meant is that each wire carries the same signal voltage but of different polarities, i.e., +5.0 volts and −5.0 volts and the like. In the typical construction, each signal cable 30 will further include one or more drain wires 36, 36A that are associated with the signal wires 32 and which themselves are terminated to a ground terminal 38 of the terminal module. Each signal cable may have two drain (ground) wires 36 and 36A (FIG. 6) associated therewith, although the bottom drain wire is not visible in FIG. 3, but is visible in FIGS. 6 and 11. As is known in the art, each signal wire 32 of each signal cable 30 is enclosed by an outer insulative covering 31. In addition, the two signal cables 30 are encased by an outer insulating sheath 40. Finally, each signal cable may include a grounding shield in the form of a metal braided tube or a conductive coated plastic encircling the insulated signal wires, but which is not shown in the drawings.

Figure 4:
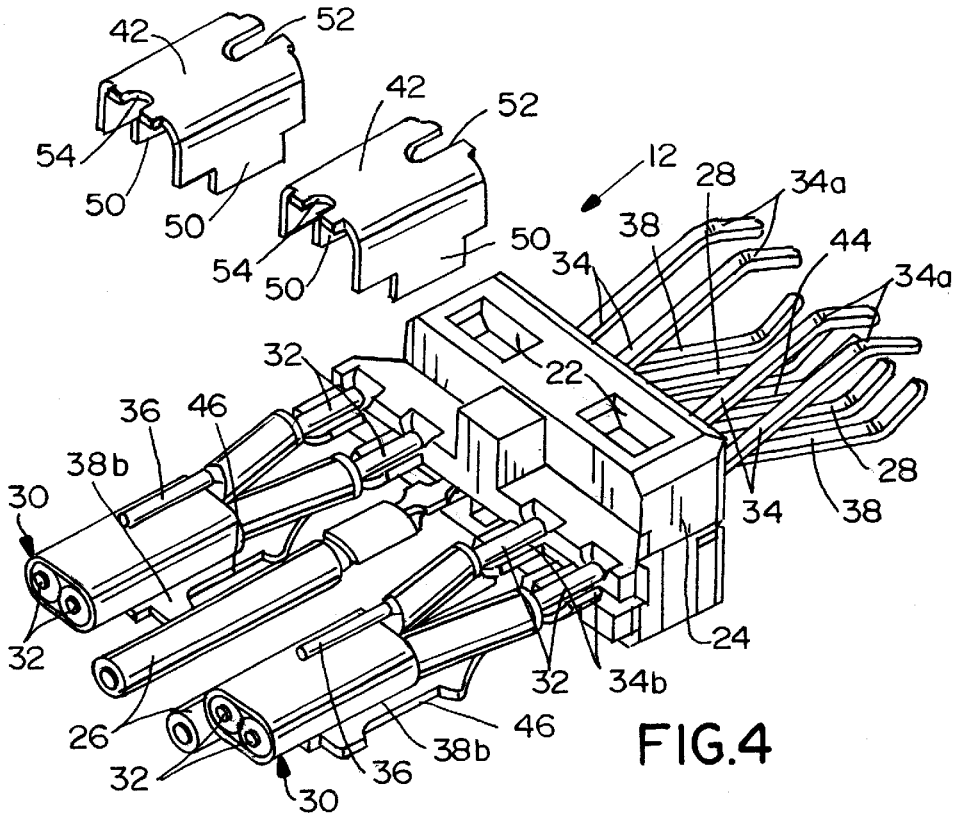
FIG. 4 is a partially exploded view of FIG. 3, with the termination retainers removed for clarity.
Figure 5:
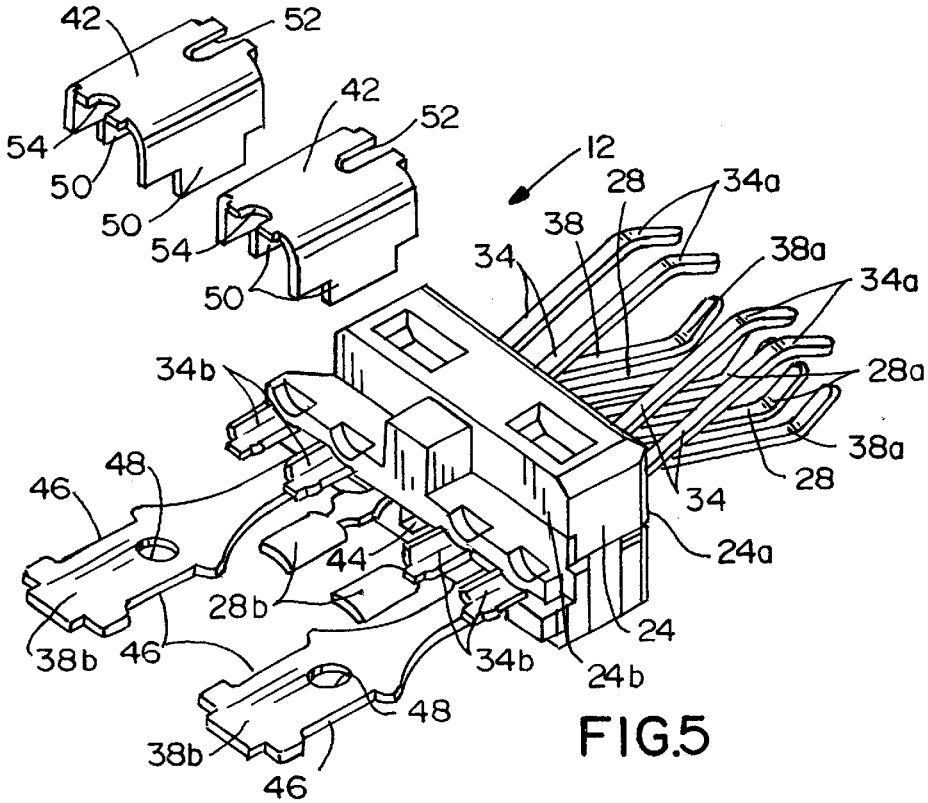
FIG. 5 is a view similar to that of FIG. 4, with the cables removed.

The housing 24 of terminal module 12 is preferably molded of a plastic, or other electrically insulative material. All of the power terminals 28, signal terminals 34 and ground terminals 38 are supported on the housing by preferably molding the housing about the terminals intermediate the opposite ends thereof. In addition to the housing and terminals, the termination assembly preferably includes a pair of retention clips, or retainers, 42 that cooperate with termination portions of the ground terminals 38 to enclose the ends of the signal cables 30 therebetween and to provide a means for managing the orientation of the signal wires and drain wires. In addition to their other functions, these retainers clips 42 also serve to provide some strain relief to the overall termination assembly. FIG. 4 illustrates the retainer clips 42 lifted off of the signal cables 30, and FIG. 5 shows an exploded perspective view of the terminal module, with the signal cables 38 and power cables 26 completely removed for clarity. As shown in the drawings, the retainer clips 42 are preferably U-shaped, and when attached to the ground terminals 38, the wires are entirely encompassed by the clip and ground terminal. Both the retainer clip 42 and the ground terminal 38 are conductive and thus, the combination of the two elements provides a conductive surface (shielding) entirely around the cable and its two signal wires, while holding the two signal wires in place. In this regard, the present invention provides the termination aspect of this connector with mechanical and electrical beneficial aspects.

More particularly, FIG. 5 illustrates that the power terminals 28 have contact portions 28*a* that project forwardly of a mating face 24*a* of the overmolded housing 24. These power terminals have termination portions 28*b* that project rearwardly of a rear or terminating face 28*b* of the housing 24 for connection, as by soldering, to the conductors of the power cables 26 (FIG. 3). The signal terminals 34 likewise have contact portions 34*a* that project forwardly of the mating face 24*a* of housing 24 and termination portions 34*b* that project rearwardly of terminating face 24*b* of the housing for connection, again such as by soldering, to the signal wires 32 of signal cables 30. The ground terminals 38 have contact portions 38*a* that project forwardly of the housing mating face 24*a* and longer, termination portions 38*b* that project rearwardly of the connector housing termination face 24*b*. The terminal module 12 also may include one or more auxiliary terminals 44 as illustrated in FIG. 5 that is disposed between the power terminals 28. Such an auxiliary terminal sometimes is used as a "blind status detect terminal" which can be shorted with one of the power or the other terminals to detect the speed of the interconnection.

The retention clips 42 are combined with the ground terminal termination portions 38*b* to form a mechanical enclosure and electrical shield completely about both a portion of the free ends of the signal cables 30, which has its outer insulating sheath cut-off to expose the internal ground (drain) wires and the signal wires and ends of the signal cables 30 as shown in FIG. 3. The retention clips 42 and the termination portions 38*b* of the ground terminals 38 also provide means for managing the orientation and termination of the signal cable drain wires 36, 36A.

Each termination portion 38*b* of the ground terminal 38 preferably includes a pair of recesses, preferably in the form of slots 46, that are disposed along the opposite side edges thereof, as well as a through-hole or similar opening, 48 that is formed in the body portion of the ground terminal termination portion 38*b*. The termination portion 38*b* may also include a flat mounting portion 80 in order to define a mounting platform on which one of the multi-wire signal cables 30 is positioned as seen in FIG. 3, so that the signal wires 32 of each cable will face the termination portions 34*b* of the signal terminals 34. Preferably, the termination portions 34*b* of the signal terminals 34 are maintained outside the terminating face 24*b* of the housing at an elevation that is above the wide termination portions 38*b* of the ground terminals 38 and preferably are aligned with the signal wire conductors 32 so that any bending of the signal wires during the termination process is kept to a minimum. Each of the signal terminal termination portions 34*a* are further preferably semi-circular or slightly "cupped" so as to cradle the signal wire conductors and provide a reliable soldering location therefor.

Each retainer clip 42 is preferably stamped and formed of sheet metal material and has an overall U or C-shaped configuration with a backbone portion and two leg portions extending therefrom which terminate in two free ends. Each retainer clip 42 further preferably includes a pair of side engagement tabs, or tongues, 50 disposed at their free ends for positioning the clip within the side recesses 46 of the ground terminals termination portions 38*b*. The side tabs 50 have a length that permits them to be inserted into the corresponding recesses 46 of the termination portions 38*b* and subsequently crimped, or deformed, about the bottom of the termination portion 38*b* to secure the retainer clips 42 thereto and form enclosing shields about the open ends of the signal cables 30. Alternatively, the side tabs 50 may be welded or soldered to the ground terminals along the side recesses 146. An opening in the form of a notch or recess 52 is preferably formed at the front top edge of each retainer clip 42 and, as explained in greater detail below, is preferably positioned along the center of the retainer clip 42 and it extends lengthwise into the body portion 42*a* of the retainer clip. Another such notch 54 may also be provided at the top rear edge of the retainer clip 42 with the two notches 52, 54 being longitudinally aligned with each other along the backbone portion of the retainer clip 42.

In assembly, the signal cable ends are first prepared by stripping the distal end of the insulated sheath 40 to expose their associated signal wires 32 and drain wires 36*a*, 36*b*. The signal wires insulation 31 is also stripped to expose their internal conductors 32 for termination. Next to the bottom drain wire 36*a* is bent 90 degrees and inserted into through hole 48 of ground terminal termination portion 38*b* while the signal wire conductors 32 are located in the cupped termination portions 34*a*. The bottom drain wire 36A is bent a second time so that it engages the termination portion 38*b*. The retainer clips 42 are then positioned over the ends of signal cables 30 as seen in FIG. 3, so that the clip tabs 50 engage the recesses 46 of the ground terminal termination portions 36*b*, and the side tabs 50 of the clips 42 are then bent or crimped downwardly and inwardly beneath termination portions 38*b* of the ground terminals, as seen in FIG. 6. The clips 42 are thereby securely clamped, or otherwise attached to the termination portions to sandwich and clamp the cables 30 between the clips 50 and the ground terminal termination portions 38*b*. The clips are formed of metal and therefore, when in contact with the ground terminal termination portions 38*b*, they provide electrical shielding around the entire extent (in combination with the termination portion 38*b*) of the free end of the signal cables 30, i.e., the area in which the cable outer insulation is stripped and cut. This cutting and stripping exposes the cable drain wires, and the upper drain wires 36 are then preferably positioned within top front notches 52 (FIG. 3) of the clips 42, and are bent back over the outside of the clips 42 so that they lie above the signal wires 32 of the cables 30. Finally, the internal conductors 32 are soldered to the cupped termination portions 34*a* and the bottom drain wire 36*a* is soldered to the ground terminal termination portion 38*b* and the top drain wire 36 is soldered to the body portion 42*a* of the retention clip 42. The respective clip 42 and termination portion 38*b* extend forwardly beyond the stripped distal end of the cable in order to preferably encompass, or enclose the free end.

As seen in FIG. 6, each signal cable 30 also includes a second (shown best in the lower part of FIG. 6) drain wire 36*a* at the bottom of the cable. Although this second drain wire 36*a* is shown at the bottom of the signal cables 30 between the signal wires thereof, it will be understood that the two drain wires 36, 36*a* may be wrapped around two associated signal wires in a twisted fashion wherein they alternate in their location in concordance with the helical spiral that they may follow along the length of the cable, so that the drain wires, as do the signal wires, alternate in circumferential quadrants lengthwise of the cables 30. For most efficient use of the present invention, the drain wires 36, 36*a* are oriented so that they will be oriented in the top and bottom arrangement illustrated, where they are maintained above and below the signal wire conductors of the cables. The bottom drain wires 36*a* are inserted through holes 48 (FIG. 5) in the ground terminal termination portions 38*b*. Like the upper drain wires 36, the lower drain wires 36A are bent back rearwardly over the outside of termination portions 38*b* (FIG. 6). The top and bottom drain wires 36 36*a* thus may be maintained in an arrangement where each is preferably equidistance from the signal wire conductors 32 to resemble their spacing within the signal cables 30.

The result of this arrangement of the drain wires in the termination areas of signal cables 30 results in an excellent maintenance of the electrical performance integrity from signal cables 30 through the termination areas of terminal module 12 and, consequently, through connector assembly 10. Mechanical variability in the termination areas is practically eliminated because holes 48 in termination portions 38*b* of the ground terminals and notches 52 in the retention clips 42 provide definite locations to position the drain wires. As is seen best in FIG. 6, the free ends of the drain wires 36, 36*a* are oriented in their respective slots 52 and openings 48 on the ground terminal termination portions 38*b* in alignment with the portions of the drain wires 36, 36*a* within the signal cables 30, and at the 180° orientation that exists in the signal cables. In this manner, the structure of the cables 30 within their termination portions are maintained. This imposes a measure of uniformity on the terminal module termination area that seems to maintain the impedance of the system in the termination area to a level closer to that of the signal cable, thereby avoiding any large impedance discontivities in the system. Additionally, the retention clip 42 allows the exposed portions of the signal cables to be shortened and enclosed in order to reduce high impedance peaks. All of these advantages are combined in a structural combination wherein clips 42 and the termination portions of the ground terminals combine to form shields about the termination ends of the signal cables.

The clips 42 of the present invention may be considered as "staples" that secure and enclose the signal cables to the plug connector termination area. With the openings and slots for the drain wires, the invention serves to stabilize a twisted pair of differential signal wires in a signal cable and maintains the 180° separation relationship through the termination area.

Figure 7:
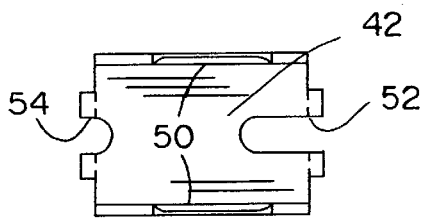
FIG. 7 is a bottom plan view of the wire grounding clamp used with the present invention.
Figure 8:
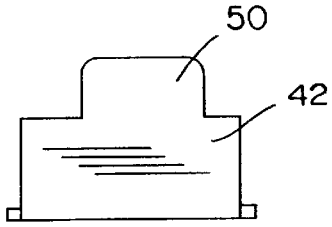
FIG. 8 is a side elevational view of the wire grounding clamp of FIG. 7.
Figure 9:
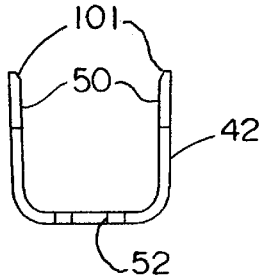
FIG. 9 is an end elevational view of the wire grounding clamp of FIG. 7.

FIGS. 7–9 illustrate the clip 42 as a single element. In FIG. 9, it can be seen that the end tabs 50 have an internal taper 101, which may facilitate placement of the clip 42 onto the termination portion of the ground terminal. As shown in FIG. 7, the wire notches 52, 54 may have different lengths, if desired.

Figure 10:
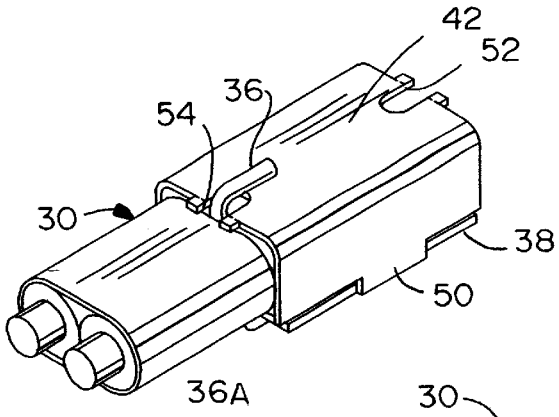
FIG. 10 is a perspective view of the wire grounding clamp attached to a terminal and illustrating an alternate manner of attaching the ground wires to the wire grounding clamp; and, FIG. 11 is a side elevational view of the assembly of FIG. 10.
Figure 11:
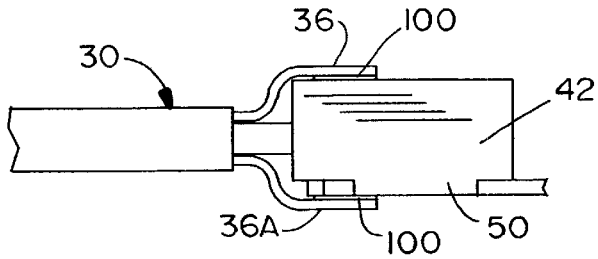

FIGS. 10 and 11 illustrate an alternate manner of using the clip 42 to terminate the ends of multi-wire cables 30. In this alternate embodiment, the drain wires 36, 36A are not pulled back upon either the clip or termination portion, but rather, they are bent up and over from at the front of the clip, in notch 54 and at the front of the termination portion. This alternate construction may be used to facilitate the assembly of the termination.

These and other objects, features and advantages of the present invention will be clearly understood through a consideration of the following detailed description.

What is claimed is:

1. An electrical connector for terminating an end of a cable, the cable having at least one pair of signal wires and at least one associated ground wire protruding from the cable end, the connector comprising:

a connector housing having a mating end and a terminating end;

a pair of signal terminals supported by the connector housing and having contact portions disposed along the connector housing mating end for contacting terminals of a mating connector, and termination tail portions disposed along to said connector housing terminating end for terminating to said signal wires;

a ground terminal supported by said connector housing and having a contact portion disposed along said connector housing mating end and a termination tail portion disposed along said housing terminating end for termination to said cable ground wire; and, a retention member that is engageable with said ground termination tail portion for clamping a portion of said cable to said ground termination tail, the retention member and said ground termination tail portion cooperatively encompassing a portion of said cable end therebetween.

2. The connector of claim 1, wherein said retention member is formed from an electrically conductive material, and said retention member and ground termination tail portion cooperatively define a conductive shield that extends completely around said cable end to thereby provide shielding thereto.

3. The connector of claim 1, wherein said ground termination tail portion includes an opening through which an end of said ground wires is passed and bent over an exterior surface of said ground termination tail portion.

4. The connector of claim 3, wherein said cable includes a second ground wire and said retention member includes a notch formed in an edge thereof, the notch being spaced apart from and aligned with said ground termination tail portion opening, said second ground wire passing through said notch and onto an exterior surface of said retention member.

5. The connector of claim 1, wherein said retention member has a backbone and two free ends that are spaced apart from each other, the free ends terminating in engagement tabs and said ground termination tail portion having a pair of slots disposed therein in opposition to said retention member engagement tabs, the tabs being received within the slots when said retention member is engaged with said ground termination tail portion to thereby define a conductive path entirely around said cable end.

6. The connector of claim 1, wherein said retention member has a U-shaped configuration, and includes a backbone and two free ends, the backbone being spaced apart from said ground termination tail portion when said retention member is applied thereto, said backbone having an exterior surface that extends parallel to said signal wires at said cable end.

7. The connector of claim 2, wherein said retention member engagement tabs includes deformable portions for crimping over portions of said ground termination tail portion.

8. The connector of claim 2, wherein said retention member includes a pair of notches formed in front and rear edges thereof, said notches being aligned longitudinally with each other and spaced apart from said ground termination tail portion slots.

9. The connector of claim 2, wherein said retention member engagement tabs includes deformable portions for crimping over portions of said ground termination tail portion.

10. The connector of claim 1, wherein said cable further includes a second ground wire associated with said two signal wires, ends of said associated ground wires being supported on exterior surfaces of said retention member and said ground termination tail portion in a spaced-apart relationship from each other and from said signal wires.

11. The connector of claim 10, wherein said retention member and said ground termination tail portion cooperatively form a hollow cavity through which said signal wires and ground wire ends extend, said ground wires respectively exiting past said retention member and passing through said ground termination tail portion and being folded back upon exterior surfaces of said retention member and ground termination tail portion.

12. A terminal module for use in mating a cable to a mating connector, the cable including at least one pair of signal wires and a pair of ground wires associated with the signal wires, the module comprising:

an electrically insulative housing, at least three conductive terminals supported by the housing, the terminals including two signal terminals and one ground terminal, each of the terminals including contact portions for contacting terminal of the mating connector and tail portions for terminating to said signal and ground wires, the two signal terminal tail portions being spaced apart from each other in a first direction and further being spaced apart from the ground terminal tail portion in a second direction, different than the first direction, said ground terminal tail portion having a wide base of a given length for at least partially supporting said two signal wires thereupon in place within the module and in alignment with said signal terminal tail portions, and a retainer clip for holding said signal wires in place upon said ground terminal tail portion, the retainer clip being engageable with said ground terminal tail portion so as to cooperatively define therewith, a hollow enclosure that completely encircles said signal wires.

13. The terminal module of claim 12, wherein said retainer clip includes a conductive shell having a backbone portion and two free ends, the two free ends being engageable with said ground terminal tail portion.

14. The terminal module of claim 13, wherein said ground terminal tail portion includes a plurality of slots that receive the conductive shell free ends.

15. The terminal module of claim 12, wherein said retainer clip has a U-shape with a body portion and two spaced-apart engagement tabs that extend away the retainer clip body portion, and said ground terminal tail portion includes a pair of slots that receive said retainer clip engagement tabs therein.

16. The terminal module of claim 12, wherein said retainer clip includes at least one notch formed in an exterior edge thereof, the notch receiving one of said ground wires bent back upon an exterior surface of said shell, and said ground terminal tail portion includes an opening aligned with said shell notch, the opening receiving the other of said ground wires bent back upon an exterior surface thereof.

17. The terminal module of claim 12, wherein ends of said two ground wires are respectively supported on exterior surfaces of said retainer clip and ground terminal tail portion in orientations above and below said signal wires.

* * * * *